US011123941B2

(12) United States Patent
Dieckmann et al.

(10) Patent No.: US 11,123,941 B2
(45) Date of Patent: Sep. 21, 2021

(54) SYSTEM AND METHOD FOR PRODUCING BAGS OR POUCHES

(75) Inventors: Franz-Josef Dieckmann, Mettingen (DE); Andreas Schroedter, Ladbergen (DE); Thomas Hawighorst, Hasbergen (DE)

(73) Assignee: WINDMOELLER & HOELSCHER KG, Lengerich (DE)

( * ) Notice: Subject to any disclaimer, the term of this patent is extended or adjusted under 35 U.S.C. 154(b) by 243 days.

(21) Appl. No.: 13/512,146

(22) PCT Filed: Nov. 24, 2010

(86) PCT No.: PCT/EP2010/007112

§ 371 (c)(1),
(2), (4) Date: Jul. 13, 2012

(87) PCT Pub. No.: WO2011/063941

PCT Pub. Date: Jun. 3, 2011

(65) Prior Publication Data

US 2012/0270714 A1 Oct. 25, 2012

(30) Foreign Application Priority Data

Nov. 25, 2009 (DE) ..... 10 2009 047 145.6
Dec. 1, 2009 (DE) ..... 10 2009 047 362.9

(51) Int. Cl.
*B31B 70/88* (2017.01)
*B31B 70/00* (2017.01)
(Continued)

(52) U.S. Cl.
CPC ..... *B31B 70/00* (2017.08); *B31B 70/006* (2017.08); *B31B 70/98* (2017.08);
(Continued)

(58) Field of Classification Search
CPC ..... B31B 19/98; B31B 29/00
(Continued)

(56) References Cited

U.S. PATENT DOCUMENTS 4,854,928 A * 8/1989 Fukuyama ..... B31B 19/74 493/194
5,135,460 A * 8/1992 Feustel ..... 493/1
(Continued)

FOREIGN PATENT DOCUMENTS

DE 38 23 032 1/1990
DE 39 31 967 4/1991
(Continued)

OTHER PUBLICATIONS

Wirth, "Flexicble Fertigungssysteme:: Gestaltund und Anwendung in der Teilefertigung", Hütig Buch Verlag, 1990 pp. 192-202, Berlin, German Democratic Republic.

*Primary Examiner* — Anna K Kinsaul
*Assistant Examiner* — Chinyere J Rushing-Tucker
(74) *Attorney, Agent, or Firm* — Jacobson Holman PLLC

(57) ABSTRACT

A system for manufacturing sacks or bags includes at least two sack or bag producing machines which control components are assigned to, and which are connected with each other by at least one transport device and/or one storage device. The system includes a control unit configured such that manufacturing speeds of the two sack or bag producing machines can be transmitted to and/or processed by the control unit. The control unit is configured such that it proposes and/or sets the manufacturing speed of the two sack or bag producing machines based on system operating parameters.

10 Claims, 2 Drawing Sheets

(51) Int. Cl.

| | |
|---|---|
| *B31B 160/20* | (2017.01) |
| *B31B 160/10* | (2017.01) |
| *B31B 70/98* | (2017.01) |
| *B31B 150/00* | (2017.01) |

(52) U.S. Cl.
CPC ... *B31B 2150/00* (2017.08); *B31B 2150/0014* (2017.08); *B31B 2160/10* (2017.08); *B31B 2160/20* (2017.08)

(58) Field of Classification Search
USPC ..... 493/267, 186, 29, 269, 179, 182, 196, 493/197; 53/52, 55, 58
See application file for complete search history.

(56) References Cited

U.S. PATENT DOCUMENTS

| | | | | |
|---|---|---|---|---|
| 5,152,472 | A * | 10/1992 | Spang et al. | 242/554.2 |
| 5,388,746 | A | 2/1995 | Hatchell et al. | |
| 5,908,169 | A * | 6/1999 | Brinkmeier | B65H 23/10 242/419.3 |
| 5,967,011 | A | 10/1999 | Feldkamper et al. | |
| 6,024,683 | A | 2/2000 | Wilkes | |
| 7,618,360 | B2 | 11/2009 | Daher et al. | |
| 7,702,483 | B2 | 4/2010 | Duwendag | |
| 2002/0155936 | A1* | 10/2002 | Wied et al. | 493/395 |
| 2006/0169753 | A1* | 8/2006 | Piucci | B65D 27/005 229/68.1 |
| 2006/0263194 | A1* | 11/2006 | Ahlers et al. | 414/793 |
| 2007/0028561 | A1* | 2/2007 | Douglas | 53/251 |
| 2008/0052025 | A1* | 2/2008 | Duwendag | B31B 70/00 702/95 |
| 2008/0140439 | A1* | 6/2008 | Hoffman | G05B 19/41865 705/317 |
| 2009/0094946 | A1* | 4/2009 | Trinko | G01N 21/89 53/456 |
| 2009/0287330 | A1* | 11/2009 | Overley et al. | 700/96 |
| 2010/0287879 | A1* | 11/2010 | Donati et al. | 53/52 |

FOREIGN PATENT DOCUMENTS

| | | |
|---|---|---|
| DE | 41 35 786 | 5/1992 |
| DE | 195 40 148 | 4/1997 |
| DE | 195 40 150 | 4/1997 |
| DE | 196 21 586 | 12/1997 |
| DE | 197 04 332 | 8/1998 |
| DE | 100 22 272 | 10/2001 |
| DE | 103 27 646 | 3/2004 |
| DE | 103 09 893 | 4/2004 |
| DE | 103 09 131 | 9/2004 |
| DE | 103 30 750 | 2/2005 |
| DE | 10 2004 055 325 | 5/2006 |
| DE | 10 2005 049 964 | 8/2007 |
| EP | 0 711 724 | 5/1996 |
| EP | 1 593 614 | 11/2005 |
| EP | 1 892 086 | 2/2008 |
| WO | WO 2005/018923 | 3/2005 |
| WO | WO 2009083595 A1 * | 7/2009 |

* cited by examiner

SYSTEM AND METHOD FOR PRODUCING BAGS OR POUCHES

CROSS-REFERENCE TO RELATED APPLICATIONS

This is a national stage of PCT/EP10/007112 filed Nov. 24, 2010 and published in German, which claims the priority of German number 10 2009 047 145.6 filed Nov. 25, 2009, and priority of German number 10 2009 047 362.9 filed Dec. 1, 2009, hereby incorporated by reference.

BACKGROUND OF THE INVENTION

1. Field of Invention

The invention relates to a system for manufacturing sacks or bags, comprising at least two machines which control elements are assigned to and which are connected with each other by at least one transport and one storage device.

Furthermore, the invention relates to a method for manufacturing sacks or bags, in which at least two machines are being operated and in which at least one transport and one storage device transport and/or store bags or semi-finished sacks between the at least two machines.

2. Description to the Prior Art

A plurality of steps are required for the manufacture of sacks or bags, which are performed in at least two machines, forming the system mentioned above. Generally, tube pieces made of one or a plurality of flat material webs, usually made of paper and/or synthetic webs, are normally produced first, by initially pooling these webs to create a tube, whereby the overlapping marginal areas are glued together with an adhesive. Next, the tube is separated into tube pieces. This machine for creating tube pieces is known as tube extruding machine. This type of tube extruding machine is disclosed in the published document DE 197 04 332 A1.

Bottoms are formed on one or both open ends of these tube pieces in a so-called bottom jointing machine, by putting on the ends with the creation of rectangular bottoms or triangular pouches. Parts of the rectangular bottoms are subsequently folded back, in part after inserting a valve patch, and glued shut with adhesive. A fillable sack is created in this fashion. Interior bolts and/or bottom cover sheets can additionally be glued onto suitable positions inside this machine. Finally, the sacks are arranged in sack stacks. Important functions of bottom jointing machines can be found in the published documents DE 195 40 148 A1, DE 195 40 150 A1, DE 196 21 586 A1, DE 103 09 893 A1, D1 103 27 646 A1, EP 1 892 086 A1 and DE 103 30 750 A1.

In another machine known as the palletizer, sack stacks can be arranged on pallets to enable the transport of large amounts of sacks in an easy fashion. These kinds of palletizers are described in the published documents DE 100 22 272, DE 103 09 131 and DE 10 2005 049 964 A1.

Additional machines can be integrated into the production process.

Within the scope of this patent application, the term machine refers to any machines used to process, machine, treat, arrange or otherwise alter material, such as for example material webs, tube pieces or finished sacks. Control components are assigned to the machines used to control the functions and units required for operating the machine. These control components can be hardware elements such as an SPC (stored program control) or an IPC (industrial PC). Software code can also be part of the control components. In the process, the control can be based on operator-defined specifications. For example, the operator can specify the manufacturing speed.

At least one transport or storage device each is provided between the individual machines to combine the machines with each other. This means that the workpieces, i.e. the tube pieces or sacks can be transported between the machines with these transport and/or storage devices, wherein these devices are designed to retain a certain amount of workpieces (storage volume). This means that every workpiece taken over by a machine from a transport and/or storage device is not immediately further processed by the next machine in the production flow. In fact, the workpiece remains inside this device. This allows the adhesives to cure sufficiently. Furthermore, it creates a buffer in case one machine is unable to work at the intended capacity. Accordingly, the transport and/or storage devices represent a depository. The workpieces are generally not modified inside the transport and storage devices, but only change the location. The workpieces can be transported or stored individually, but preferably in stacks. This type of transport and/or storage device is disclosed in WO 2005/018923 A1.

The system's maximum operational capacity is achievable if all of the mentioned machines and transport and storage devices are operated with the same manufacturing speed which is as high as possible. In the process, the maximum manufacturing speed is determined by the slowest machine which commonly is the bottom jointing machine.

Different influences reduce the actual manufacturing speeds of the machines, in particular the tube extruding machine and the bottom jointing machine. For example, production in the tube extruding machine needs to be stopped if a roll which the material webs are normally wrapped onto needs to be exchanged. This often means that the material supply for the bottom jointing machine is also interrupted, making it idle or in need of being stopped as well. In the first case, this results in an unnecessary waste of resources. In the second case, the machine needs to be rebooted to the manufacturing speed which normally results in so-called start-up scrap (production of unusable sacks or bags) aside from wasted time. In other words, the actual operational capacity achieved in the practice often falls short of the maximum possible operational capacity.

SUMMARY OF THE INVENTION

The object of the present invention is therefore to propose a device and a method with which the actual operational capacity can be increased.

The object is solved with a system according to the various embodiments thereof described herein.

Accordingly, a control unit is provided which is equipped in such a way that the manufacturing speeds of at least two machines can be transmitted to it and which is designed in such a way that it proposes and/or sets the manufacturing speeds of at least two machines based on system operating parameters. It is particularly advantageous if the absolute manufacturing speeds are proposable and/or settable.

Furthermore, the object is solved with a method in which the manufacturing speed of the at least two machines and at least one other operating parameter of the machines, transport and/or storage positions is reported to a control unit and the control unit proposes and/or sets the manufacturing speed of at least one or at least two machines based on the reported values, The term "values" is used representative of the manufacturing speed and the at least one other operating parameter.

The invention is based on the idea that a machine should be able to produce whenever it is production-ready. This means that the preceding transport and/or storage device must be able to accept workpieces and/or that the processed workpieces must also be accepted by a following transport and/or storage device. Consequently, the depository capacity of the transport and/or storage device must never be fully exploited, i.e. the transport and/or storage device must never be completely empty or full. This way, idling or stoppage and the associated start-up scrap can be prevented.

In order to achieve this, the control unit records at least one other operating parameter aside from the manufacturing speeds, to be able to respond accordingly. The response is expressed in the setting of suitable manufacturing speeds to ensure that both workpieces as well as free spaces are available in all transport and storage devices.

An advantageous embodiment provides that the control unit proposes and/or sets the manufacturing speed of at least one machine of a preceding and/or the following machine based on the reported values. For instance, if the roll needs to be exchanged in the tube extruding machine, the manufacturing speed of the bottom jointing machine can be reduced accordingly ahead of time to achieve a corresponding filling of the depository. Alternatively, a higher filling level of the depository can be achieved by operating the tube extruding machine at a higher manufacturing speed ahead of the roll exchange.

In so doing, it is advantageous if the control unit controls the manufacturing speed of at least one machine in such a way that the filling level of at least one transport and/or storage device approaches a target value. It is preferable if one machine is controlled such that the filling level of the following transport and/or storage device approaches a target value.

Moreover, it is advantageous if this target value is adjusted by the control unit during the course of the production. This makes it possible to reduce the target value for the depository occupancy of the preceding transport and/or storage device and/or increase the target value for the depository occupancy of the following transport and/or storage device in connection with an impending reduction of the manufacturing speed of a machine.

In so doing, the target value can adopt different numerical values. They can range between an upper limit and a lower limit, where the limits are within the storage volume. These numerical values can be relative values to the maximum storage volume. For example, the target values can range between 10% and 90% of the maximum storage volume of the corresponding transport and/or storage device. These limits can also be measured with set values, such as the number of sacks or number of sack stacks. In another embodiment of the invention, it is provided that these limits can be exceeded or reduced if unforeseeable changes of the operating parameters such as disruptions occur which result in the stoppage of a machine. The limits can be defined or operator-definable or settable during the operation. Narrower limits (for example between 20% and 80%) and correspondingly greater storage reserves can be advantageous if higher failure rates are suspected. Likewise, broader limits can be advantageous for example if the production process is very stable.

Aside from the manufacturing speeds, the control unit also records an additional operating parameter which is capable of influencing the optimal manufacturing speed. These operating parameters can be classified into two parts. On the one hand, they are parameters recorded once, for example at the production start of an order. They include the sack format, the adhesive to be used, the scope of the order (order quantity), the diameter of the roll sleeves, specified cleaning or maintenance intervals, the curing time required for proper gluing, the maximum possible accelerations of the machines depending on the product, the maximum machine speed depending on the product and the maximum storage volume of the transport and/or storage devices. In the process, the storage volume is indicated as number of storage tube pieces, sacks or bags. The optimal machine speed can be another operating parameter. This parameter can be based on experimental values. Some of the listed parameters can be calculated by the control unit. For example, the maximum storage volume can be calculated from the sack format. These values can be entered or determined for a follow-up order already during the ongoing order, thus enabling the control unit to set and/or propose the manufacturing speeds of the currently processed order already in consideration of the operating parameters of the follow-up order. This way, potentially required change-over times are already taken into account in the manufacturing speeds.

However, operating parameters from the current production can also be recorded or calculated by the control unit. They include for example error messages from or failures of machine components, the current occupancy of the transport and/or storage devices, the residual run-time of the order or the current material roll diameters. Recording or calculating the roll diameter can be used to determine the time of the next roll exchange and hence the next machine stoppage. Other values can be used for this purpose as well. For example, the following transport and/or storage device can be filled sufficiently in advance of this stoppage (if necessary, the mentioned target value can be increased), by operating the preceding machine at a higher manufacturing speed and/or reducing the manufacturing speed of the following machine, thus allowing the following machine to continue with the production while the roll is exchanged. Another operating parameter is the required pallet exchange in the palletizer. In this case, it is also possible to empty the preceding transport and/or storage device and/or reduce the manufacturing speed of the preceding machine.

Furthermore, the machine operator can request stoppages with specified durations. During production, it is possible that a component is damaged which is acceptable for a certain period of time without impairing the functionality of the machine. The required stoppage to remedy said defect can be considered by the control unit which then proposes or specifies the stoppage time. Unforeseeable, but nevertheless necessary maintenance work can also be the reason for the need of a stoppage.

The mentioned operating parameters of the ongoing production can be distinguished further into foreseeable or calculable (impending exchanges, impending maintenance work, need for stoppages) and in suddenly emerging or changing (defect impairing the functionality of the machine) operating parameters.

Moreover, it is advantageous if the control unit visualizes at least part of the production parameters and/or information derived thereof on a display device on which the displayed parameters can be assigned to the respective system component. This allows the timely display of an impending roll exchange to be performed by the operator. The operator can subsequently perform the roll exchange without delay and the stoppage of the affected machine is reduced as a result, which ultimately increases the operational capacity.

It is particularly advantageous if different or even all of the methods presented in this published document are performed automated by the system control unit. The control unit can be equipped accordingly for this purpose. Said equipment can be achieved with programming. Said programming can also be performed with the use of data carriers or modern data transmission methods such as e-mail, chatting or remote maintenance methods.

Further exemplary embodiments of the invention can be derived from the description at hand and the claims.

DETAILED DESCRIPTION OF THE PREFERRED EMBODIMENTS

Figure 1:
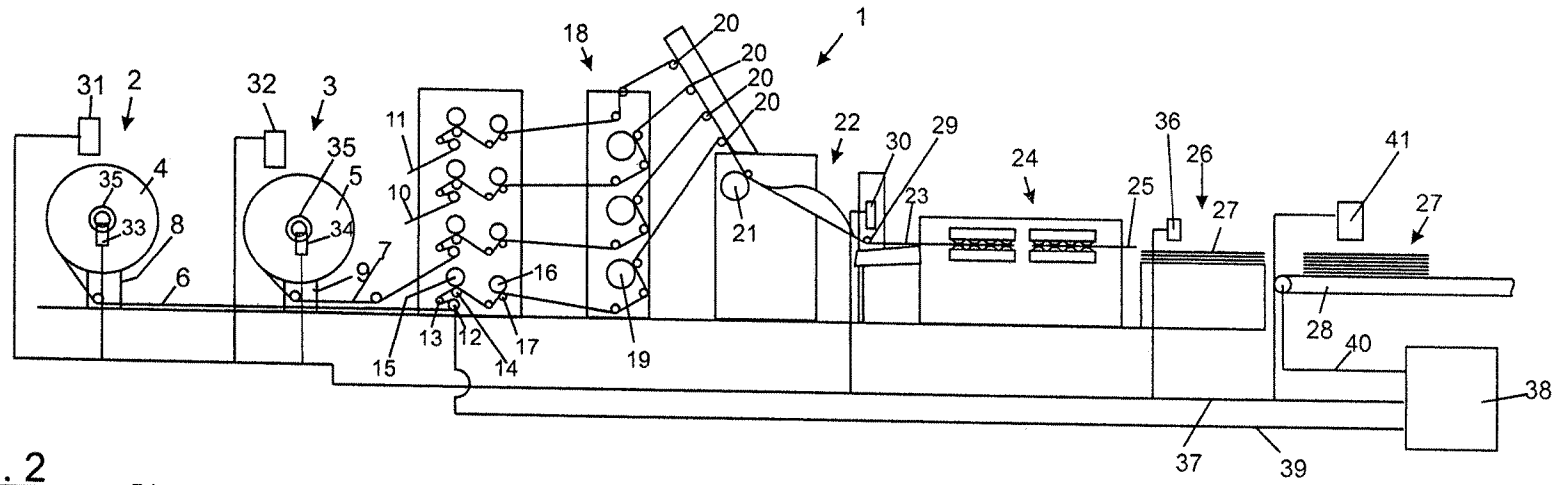
FIG. 1 shows a side view of a tube extruding machine in a system according to the invention.

Further scope of applicability of the present invention will become apparent from the detailed description given hereinafter. However, it should be understood that the detailed description and specific examples, while indicating preferred embodiments of the invention, are give n by way of illustration only, since various changes and modifications within the spirit and scope of the invention will become apparent to those skilled in the art from this detailed description FIG. 1 shows a tube extruding machine 1 as component of a system according to the invention. It shows this kind of machine for the manufacture of a four-layered tube. However, it is not restricted to four layers. Tubes with a greater or smaller number of layers may also be producible. The individual webs 6, 7 are pulled off from material rolls 4, 5 arranged in tandem and supported in unreeling devices 2, 3. Only two unreeling devices are illustrated. The material rolls 4, 5 are pivotably supported in cradles 8, 9. The pulled off webs 6, 7 are transported across guide rolls to the pre-stretching devices. The webs 6, 7, 10, 11 are pre-stretched by means of powered pre-stretching devices, each of which consists of the powered pre-stretching roller 12 and the guide roller 13 which enlarges the wrap angle. A device to create needle holes in the web is arranged behind the pre-stretching rollers 12, 13, said device consisting of a back pressure roller 14, which the inserted web runs across and which a porcupine roller 15 can be leaned against, which equips the web with needle holes either across the entire width or in stripe-shape, designed to ventilate the sacks made of the webs.

Each paper web runs from the porcupine roller to the cutter block 16 which can be leaned against the backpressure roller 17. The cutter block 16 creates a transverse perforation representing the future separation line. Next, the paper webs enter a stand 18 in which the webs 6, 7 and 10 are equipped with transverse adhesive strips by means of adhesive application rollers 19 on both sides of the transverse perforations. After pooling the webs by means of the guide rolls 20, they travel across adhesive application rollers 21 by means of which the adhesive substance is applied onto the webs in longitudinal direction. The tube formation station 22 follows, which essentially comprises guide elements such as guide sheets used to fold over and place the outer edges of the webs on top of each other. The tube 23 created in this fashion then enters a separation mechanism 24, in which the tube 23 ruptures along the transverse perforation and is separated into tube pieces 25. This kind of separation mechanism is disclosed for example in EP 0 711 724 A1. A plurality of tube pieces 25 are now used to create tube piece stacks 27 in a stacking device 26, said stacks being transported away by means of a first transport device 28.

The tube extruding machine comprises a plurality of rollers which can be powered. In addition to the previously mentioned pre-stretching rollers 12, other rollers can be designed as powered rollers. The manufacturing speed can be measured with rotary encoders provided on the powered rollers (not illustrated) or with rotary encoders provided on an idle roll. As an example, the idle roll 29 comprises a rotary encoder 30. It is also conceivable to measure the transport speed of a web directly.

The circumference of the material rolls 4 and 5 can be measured with sensors 31, 32. If the diameter of the winding sleeves 35 is known, this information can be used to determine the residual amount of material and hence to predict the time of the future roll exchange. Alternatively, rotary encoders 33, 34 which measure the rotating speeds of the material rolls are an option. The time of the roll exchange can be determined taking into account the manufacturing speed.

Another sensor 36 determines the number of tube pieces 25 in the tube piece stack 27. The data of the sensors and rotary encoders 30-34 and 36 can be made accessible to the control unit 38 via a data line 37. Additional sensor and/or measuring devices in different locations of the machine are possible. They too, would be connected to the control unit 38 via the data line 37. The control unit 38 activates the drives via the control line 39. As an example, it is shown that the control line 39 activates the idle roll 12.

Also, the transport speed of the first transport device 28 is controlled by the control device 38 via a control line 40. At least one occupancy sensor 41 can be provided in order to be able to determine the filling status of this first transport device 28.

It is not illustrated that at least one printing machine can be arranged between the unreeling devices 2, 3 and the pre-stretching rollers 12, said printing machine being used to print the unreeled webs, usually one of the webs. Operating parameters can also be defined or calculated on or in said printing machine. Sensors may be available for this purpose, which monitor for instance the filling level of the print color in the color tanks. Operating parameters of the printing machine can be transmitted to the control unit via not illustrated data lines. These operating parameters can subsequently be used to set or propose manufacturing speeds of machines.

Figure 2:
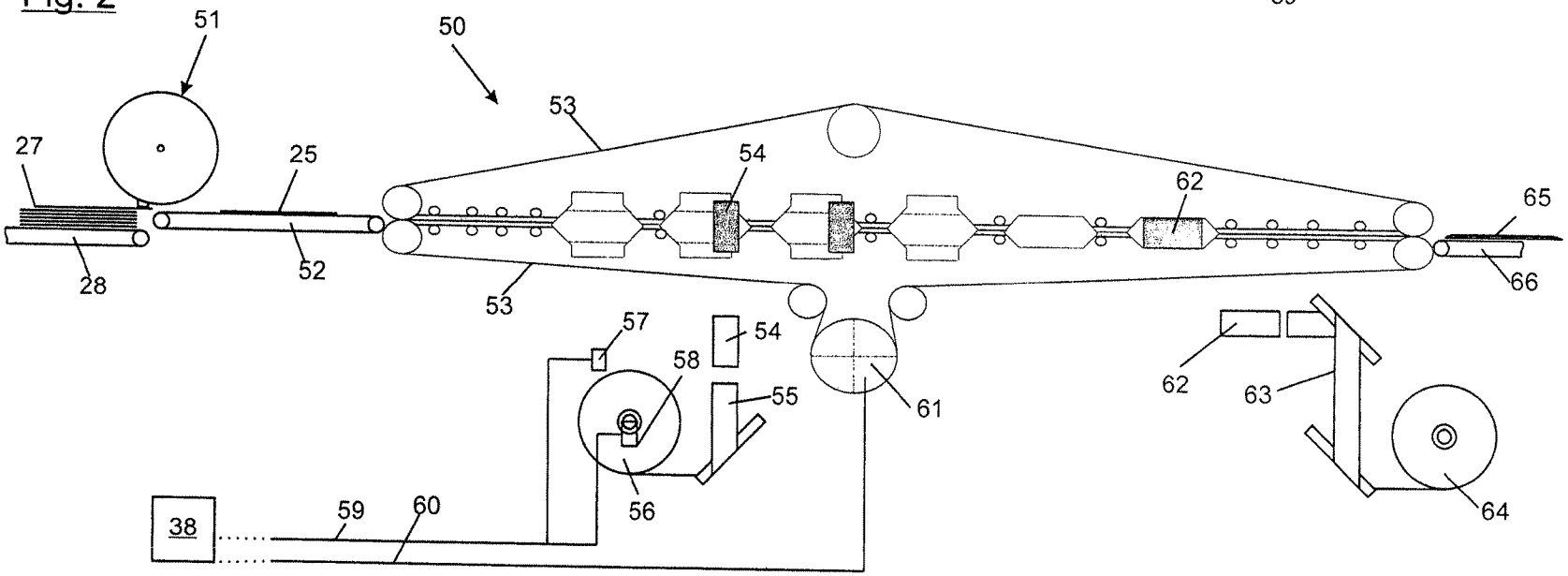
FIG. 2 shows a schematic representation of the manufacturing steps taking place in a bottom jointing machine.

FIG. 2 shows a bottom jointing machine 50, to which tube piece stacks 27 are fed via the first transport device 28. The first transport device 28 can consist of different elements. For example, a plurality of transport devices can be provided. Some of them can be used for the vertical transport or for changing the orientation of the tube pieces, relative to their transport direction. Furthermore, one or a plurality of storage elements can be provided inside which the tube pieces can remain for some time. This kind of storage element is described for example in EP 1 593 614.

The bottom jointing machine 50 takes the tube pieces 25 over in such a way that their orientation, i.e. the orientation of the longitudinal adhesive seam is transverse to the transport direction. The tube pieces 25 are removed one-by-one from the tube piece stack by a separation device 51, which can be designed as a rotational feeder unit, as indicated in FIG. 2. An alignment and transport device 52 transports the tube pieces 25 further while at the same time ensuring the proper orientation of the position of the tube pieces 25.

A twin-belt conveyor 53 takes over the individual tube pieces 25 and transports them to the individual processing stations which create bottoms on one or both ends of the tube pieces 25 in a known fashion. In the process, the ends are put on in a first step, thus creating rectangular bottoms while triangular pouches are formed on the sides. Next, a valve patch 54 can be glued on. For this purpose, adhesive from a so-called glue application mechanism is applied to the valve patch and/or areas of the tube piece 25. The valve patches 54 normally consist of paper and are created by cutting off individual patches from the material 55, which is provided as a material web roll 56. Analogous to the material web rolls 4 and 5 in the tube extruding machine 1, sensors 57 and/or rotary encoders 58 can be provided in this position, which are connected with the control unit 38 via data lines 59, in order to ultimately be able to determine the time of the impending roll exchange in advance. Moreover, components of the adhesive application mechanism, such as for example an adhesive tank, can also be equipped with sensors. Amongst other things, the control unit 38 controls the circumferential speed of the powered wheel 61 of the twin-belt conveyor 53 and hence the manufacturing speed of the bottom jointing machine 50 by means of the control line 60. The pre-stretching speed of the material web 55 is also controlled in a similar fashion, which is however not illustrated.

After the valve patch 54 has been glued on, the bottom is folded shut and glued, if necessary. Finally, a bottom cover sheet 62 can be glued on to reinforce the finished bottom. The bottom cover sheets 62 are separated from a material web 63 provided by a material web roll 64. Like in the case of the valve patches 54, corresponding sensors, rotary encoders, data lines and/or control lines are provided here as well, which is not illustrated for simplicity's sake.

Figure 3:
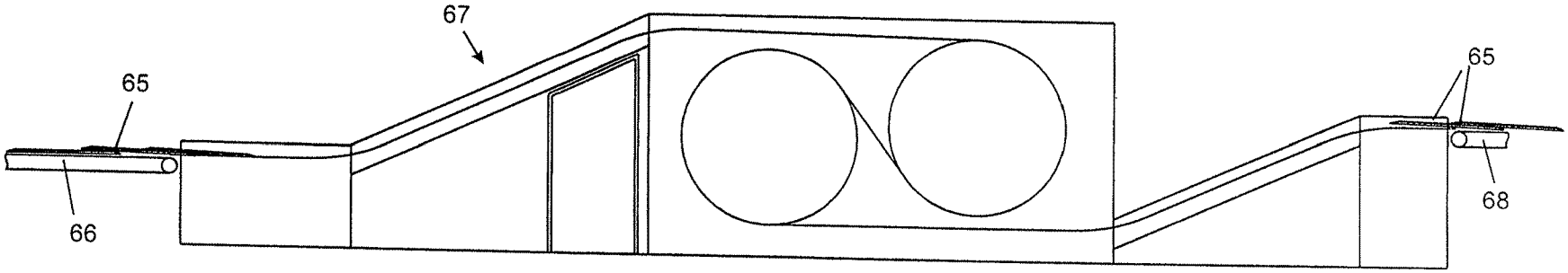
FIG. 3 shows a schematic representation of a storage device.

The sacks 65 manufactured from the tube pieces 25 in this fashion are taken over and transported away by a second transport device 66. The sacks 65 are often arranged in streams (see FIG. 3) for this purpose. As illustrated in FIG. 3, the streams are transmitted from the second transport device to a so-called deposition device 67. Said deposition device 67 transports the sacks 65 across defined pathways, while at the same time compressing the freshly created bottoms to ensure a permanent strong adhesive bond. The transport distance inside the deposition device is relatively long in order to allow the sufficient drying of the adhesive bond. The second transport device 66 can again be divided into a plurality of transport and/or storage devices. After passing through the deposition device 67, the sacks 65 reach a third transport device 68, which transports the sacks 65 to a stream counting and separation device which is not illustrated. The latter separates the streams and arranges the sacks 65 to sack stacks 69 with a defined number of sacks 65. This kind of stream counting and separation station is illustrated and explained for example in DE 10 2004 055 325 B4. The stream counting and separation station is often followed by one or a plurality of other transport and/or storage devices, for instance devices as they were described for the area between the tube extruding machine 1 and the bottom jointing machine 50. In the area behind the stream counting and separation station, individual sacks or sack stacks are often randomly withdrawn, subjected to quality control, and re-inserted into the transport chain. The time spent for the control can also be considered storage.

Figure 4:
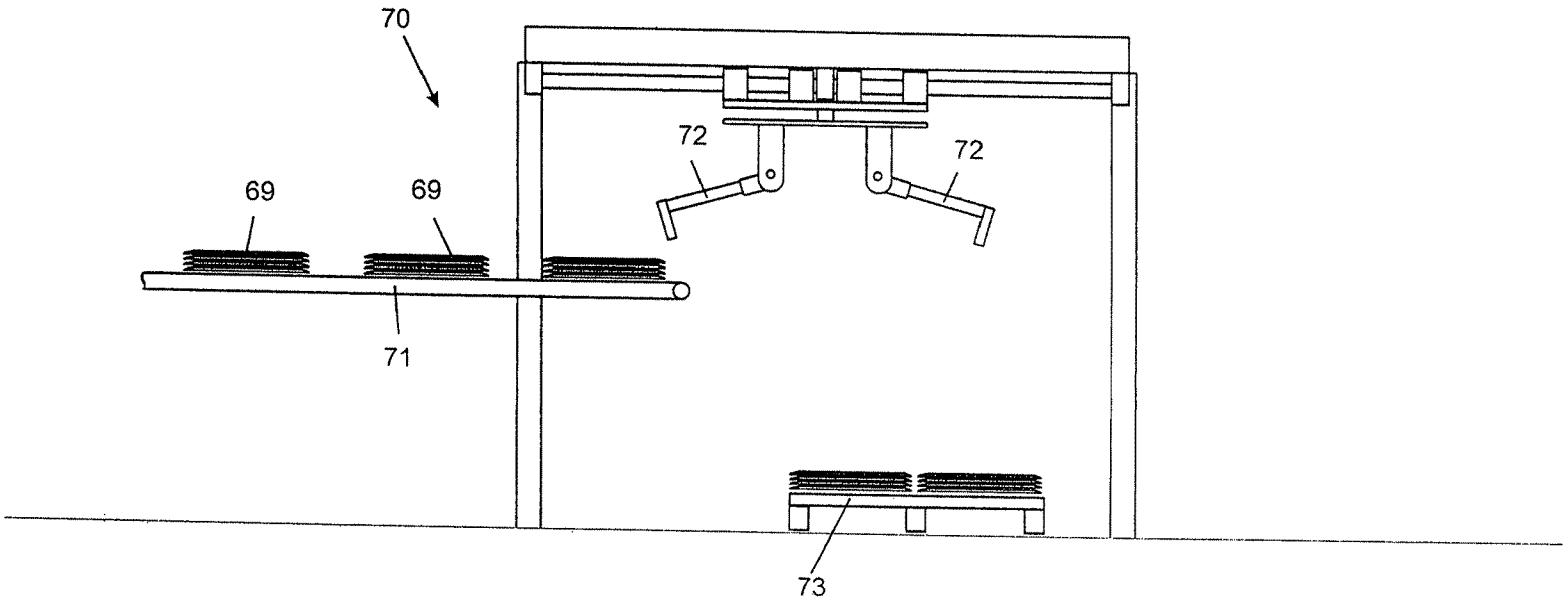
FIG. 4 shows a view of a palletizer.

FIG. 4 shows a palletizer 70 as an exemplary embodiment of a device used to arrange a plurality of sacks to a transportable sack combination. Another device is one in which sacks arranged as streams are reeled onto rolls by means of ribbons or strips.

The palletizer 70 comprises a fourth transport device 71, which brings the sack stacks 69 within the range of motion of a gripping device 72. In each case, the gripping device 72 grabs one sack stack 69 and arranges it on a pallet 73. Sensors can also be provided inside the palletizer, for example for monitoring the current occupancy of the pallet 73. The sensors are connected with the control unit 38 via not illustrated data lines. The control unit 38 can propose and/or set the palletizing speed of the palletizer in consideration of operating parameters and manufacturing speeds of other machines.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

| Reference list | |
|---|---|
| 1 | Tube extruding machine |
| 2 | Unreeling device |
| 3 | Unreeling device |
| 4 | Material roll |
| 5 | Material roll |
| 6 | Web |
| 7 | Web |
| 8 | Cradle |
| 9 | Cradle |
| 10 | Web |
| 11 | Web |
| 12 | Pre-stretching roller |
| 13 | Guide roller |
| 14 | Back pressure roller |
| 15 | Porcupine roller |
| 16 | Cutter block |
| 17 | Back pressure roller |
| 18 | Stand |
| 19 | Adhesive application roller |
| 20 | Guide rolls |
| 21 | Adhesive application roller |
| 22 | Tube formation station |
| 23 | Tube |
| 24 | Separation mechanism |
| 25 | Tube piece |
| 26 | Stacking station |
| 27 | Tube piece stack |
| 28 | First transport device |
| 29 | Idle roll |
| 30 | Rotary encoder |
| 31 | Sensor |
| 32 | Sensor |
| 33 | Rotary encoder |
| 34 | Rotary encoder |
| 35 | Winding sleeve |
| 36 | Sensor |
| 37 | Data line |
| 38 | Control unit |
| 39 | Control line |
| 40 | Control line |
| 41 | Occupancy sensor |
| 42 | |
| 43 | |
| 44 | |
| 45 | |
| 46 | |

-continued

| Reference list | |
|---|---|
| 47 | |
| 48 | |
| 49 | |
| 50 | Bottom jointing machine |
| 51 | Separating device |
| 52 | Alignment and transport device |
| 53 | Twin-belt conveyor |
| 54 | Valve patch |
| 55 | Material web |
| 56 | Material web roll |
| 57 | Sensor |
| 58 | Rotary encoder |
| 59 | Data line |
| 60 | Control line |
| 61 | Powered wheel |
| 62 | Bottom cover sheet |
| 63 | Material web |
| 64 | Material web roll |
| 65 | Sack |
| 66 | Second transport device |
| 67 | Deposition device |
| 68 | Third transport device |
| 69 | Sack stack |
| 70 | Palletizer |
| 71 | Fourth transport device |
| 72 | Gripping device |
| 73 | Pallet |

What is claimed is:

1. A system for manufacturing sacks or bags from a web, comprising:

at least a tube extruding machine, which receives the web after an adhesive has been applied thereto, and a bottom jointing machine having control components associated therewith, a transport device that provides for communication between the tube extruding machine and the bottom jointing machine, a control unit configured:

such that manufacturing speeds of the tube extruding machine and the bottom jointing machine are transmitted to and/or processed by the control unit, and to propose and/or set the manufacturing speed of the tube extruding machine and the bottom jointing machine based on system operating parameters, the system operating parameters comprising a first part and a second part, with the first part being a parameter which is recorded once before a start of a production run, and the second part being a parameter determined from a current production run, with the manufacturing speed of at least one of the tube extruding machine and the bottom jointing machine being set with the control unit (i) such that a filling level of the transport device approaches a target value and (ii) based on operating values of the tube extruding machine or the bottom jointing machine that are transmitted to and processed by the control unit, with the target value being adjustable by the control unit during the production of the sacks or bags, and with the transport device always being partially full of the sacks or bags.

2. The system according to claim 1, further comprising sensors with which at least one of the manufacturing speeds and other operating parameters are determined and transmitted to the control unit.

3. The system according to claim 1, wherein the first part of the system operating parameter is at least one of a sack format, a type of the adhesive, an order quantity, a diameter of a roll sleeve, a specified cleaning or maintenance interval, a curing time of the adhesive, a maximum acceleration of the machines depending on the bag or sack being produced, a maximum speed of the machines depending on the bag or sack being produced, and a maximum storage volume of the transport device.

4. A method of manufacturing sacks of bags from a web with at least a tube extruding machine, which received the web after an adhesive has been applied thereto, a bottom jointing machine, a transport device, and a control unit, said method comprising:

with the transport device, transporting and/or storing the sacks or bags between the tube extruding machine and the bottom jointing machine, reporting to the control unit manufacturing speeds of the tube extruding machine and the bottom jointing machines, and at least one other operating parameter of the tube extruding machine, the bottom jointing machine, and the transport device, the control unit proposing and/or setting the manufacturing speed of at least one of the tube extruding machine and the bottom jointing machine based on the reported speeds and on system operating parameters, the system operating parameters comprising a first part and a second part, with the first part being a parameter which is recorded once before a start of a production run, and the second part being a parameter determined from a current production run, such that a filling level of the transport device approaches a target value, based on operating value of a preceding or a following machine that are transmitted to and processed by the control unit, with the target value being adjustable by the control unit during the production of the sacks or bags, and with the transport device always being partially full of the sacks or bags.

5. The method according to claim 4, wherein the target value ranges between a lower limit and an upper limit within a volume of the transport device.

6. The method according to claim 5, wherein at least one of the lower limit and the upper limit is only exceeded in an event of unplanned changes of operating parameters.

7. The method according to claim 4, wherein at least one of the target value and at least one of the lower limit and the upper limit is adjusted by the control unit based on at least one of impending maintenance deadlines, length of available web material on one or a plurality of rolls, error messages of machine components, degree of occupancy of a pallet, actual value of storage occupancy, sack parameters, and data of follow-up orders.

8. The method according to claim 4, wherein a capacity of the transport device is calculated based on a format of the respective sacks or bags that are being manufactured.

9. The method according to claim 4, wherein the control unit displays at least part of at least one of the operating parameters and information derived therefrom, with the displayed parameters being assigned to a respective system component.

10. A control system for a system for manufacturing sacks or bags from a web that includes a tube extruding machine, which receives the web after an adhesive has been applied thereto, and a bottom jointing machine in communication with each other via a transport device, said control system comprising:

control components associated with the tube extruding machine and the bottom jointing machine, and a control unit configured to have transmitted thereto manufacturing speeds of the tube extruding machine and the bottom jointing machine, and to prepare and/or set the manufacturing speed of the tube extruding machine and the bottom jointing machine based on system operating parameters, the system operating parameters comprising a first part and a second part, with the first part being a parameter which is recorded once before a start of a production run, and the second part being a parameter determined from a current production run, (i) such that a filling level of the transport device approaches a target value based on operating values of a preceding or a following machine that are transmitted to and processed by the control unit, with the target value being adjustable by the control unit during the production of the sacks or bags, and with the transport device always being partially full of the sacks or bags.

* * * * *